United States Patent [19]

Miller et al.

[11] Patent Number: 4,758,536

[45] Date of Patent: Jul. 19, 1988

[54] RECEPTACLE FOR PREMISE WIRING SYSTEM

[75] Inventors: Vernon R. Miller, Atlanta, Ga.; Robert M. Renn, Pfafftown, N.C.; Lincoln E. Roberts, Decatur, Ga.

[73] Assignee: AMP Incorporated, Harrisburg, Pa.

[21] Appl. No.: 908,755

[22] Filed: Sep. 18, 1986

[51] Int. Cl.[4] ..... H01R 9/07; H01R 13/453; H01R 13/436; H01R 19/40

[52] U.S. Cl. ..... 439/138; 439/405; 439/733; 439/686

[58] Field of Search ..... 339/43, 44 R, 44 M, 339/97 R, 97 P, 98, 99 R, 217 R, 191 M, 192 R, 192 RL, 176 M; 439/136-144, 393-408, 682-691, 733, 744-749, 752, 869, 871, 872

[56] References Cited

U.S. PATENT DOCUMENTS

| | | | |
|---|---|---|---|
| 707,516 | 8/1902 | Klein | 339/43 |
| 797,215 | 8/1905 | Osborne et al. | 174/67 |
| 854,369 | 5/1907 | Mayer | 174/67 |
| 1,579,865 | 4/1926 | Hubbell | 439/138 |
| 1,621,364 | 3/1927 | Goodridge | 339/43 |
| 2,411,861 | 12/1946 | Antony, Jr. et al. | 339/217 R |
| 2,816,680 | 12/1957 | Niemeyer | 220/29 |
| 3,503,035 | 3/1970 | Lazar et al. | 439/578 |
| 3,659,248 | 4/1972 | Mann et al. | 339/44 R |
| 3,860,739 | 1/1975 | Kloth et al. | 339/99 R |
| 3,910,672 | 10/1975 | Frantz | 339/97 P |
| 3,935,637 | 2/1976 | Bunnell | 339/97 P |
| 4,023,883 | 5/1977 | Raposa et al. | 339/98 |
| 4,025,141 | 5/1977 | Thelissen | 339/99 R |
| 4,027,941 | 6/1977 | Narozny | 339/98 |
| 4,068,912 | 1/1978 | Hudson et al. | 339/99 R |
| 4,075,758 | 2/1978 | Parsons et al. | 339/99 R |
| 4,143,935 | 3/1979 | Goodman et al. | 339/99 R |
| 4,169,648 | 10/1979 | Moist, Jr. | 439/467 |
| 4,176,897 | 12/1979 | Cameron | 339/43 |
| 4,197,959 | 4/1980 | Kramer | 339/44 R |
| 4,274,696 | 6/1981 | Long et al. | 339/103 R |
| 4,319,799 | 3/1982 | Pearce, Jr. | 339/217 R |
| 4,359,257 | 11/1982 | Lopinski et al. | 339/99 R |
| 4,443,048 | 4/1984 | Moist, Jr. | 439/599 |
| 4,448,473 | 5/1984 | Felix et al. | 339/99 R |
| 4,462,654 | 7/1984 | Aiello | 439/347 |
| 4,475,784 | 10/1984 | Lukawich | 339/43 |
| 4,479,687 | 10/1984 | Humphreys et al. | 339/22 B |
| 4,544,220 | 10/1985 | Aiello et al. | 439/594 |

FOREIGN PATENT DOCUMENTS

| | | | |
|---|---|---|---|
| 3330151 | 3/1985 | Fed. Rep. of Germany | 339/217 R |

*Primary Examiner*—Gil Weidenfeld
*Assistant Examiner*—Gary F. Paumen
*Attorney, Agent, or Firm*—Eric J. Groen

[57] ABSTRACT

An electrical distribution system incorporating power, data and analog signals into a single system, and suitable for use in a building is disclosed. A flat cable containing various conductors can be positioned within the walls of the structure and a common receptacle can be employed to provide a common outlet for power and signal. The mateable plug also containing power and signal terminals is engageable with the receptacle. Shiftable doors for environmental protection are located on the exterior of the receptacle. The doors provide both guidance for the plug into the receptacle and engage the exterior of the plug to ensure that one door fully closes prior to the other.

18 Claims, 11 Drawing Sheets

4
20
22
34
32
30
12
8
100
108
46
88
46
96
192
102
64a
48
90
94
90
104
48
92
98
50
10
80
60
82
84
62
250
66
68
64b
78
76
254
74
256
78
258
76
74
82
80

222
226
210
204
4
206
192
208
194
104
118
106
110
130
240
60

RECEPTACLE FOR PREMISE WIRING SYSTEM

BACKGROUND OF THE INVENTION

1. Field of the Invention

The instant invention relates to an electrical receptacle for terminating to a cable having both power and signal conductors and means interconnectable to a mating plug, and more particularly to a receptacle for use with an improved premise electrical distribution system.

2. Description of the Prior Art

Buildings, such as office buildings, factories, and residences have become increasingly characterized by the presence of numerous separate electrical distribution systems. The distribution of power within buildings has remained substantially unchanged for a long period of time. This is especially true for electrical power distribution in residences. However, a large number of other electrical distribution systems have increasingly been employed within buildings. For example, data communications systems, telecommunications systems, audio visual communications systems, and other power distribution systems are all present within a typical residence. However, all of these electrical distribution systems remain separate. Little, if any, attempt has been made to combine the distribution of all of these signals into one system and to provide a common outlet or receptacle.

The preferred embodiment of the invention depicted herein comprises a receptacle which can be used to simultaneously establish electrical contact with power conductors, data signal conductors, and telecommunication signal conductors. In the preferred embodiment of this invention, all of these conductors are incorporated into a single flat cable and a substantially simultaneous insulation displacement contact can be established with all of the conductors.

There have been numerous attempts to use an insulation displacement principle to establish contact between a conventional duplex receptacle or a conventional switch and the conductors in a conventional three wire power cable. Examples of such insulation displacement duplex receptacles are found in U.S. Pat. Nos. 3,860,739, 3,910,672, 3,935,637, 4,075,758 and 4,274,696. Each of these prior art devices permit an interconnection to be made simultaneously with the hot, ground and neutral wires in a three conductor cable. Each of these prior art devices generally requires that the outer insulation surrounding the three wire cable must first be severed or at least partially removed and laterally deployed. Thereafter, front and rear housing elements are brought together. Slots in terminals located in one of the two housing members engage opposite sides of each wire establishing an insulation displacement type interconnection to each wire.

Connectors suitable for use in terminating a plurality of smaller, signal conductors in a flat cable include U.S. Pat. Nos. 4,027,941, 4,068,912, 4,359,257, and 4,448,473. U.S. Pat. No. 4,023,883 discloses a terminal for terminating wires of different sizes.

None of these references disclose a receptacle in which power and signal conductors are simultaneously terminated to a receptacle in an integrated wiring system.

SUMMARY OF THE INVENTION

An electrical receptacle interconnectable to a flat cable containing signal and power conductors, of different sizes, has a plug receiving face and a rear face. A plurality of electrical terminals are contained within the principal housing portion of the electrical connector, and each terminal includes a first contact portion, for engaging a terminal on a mating plug and a separate insulation displacement portion facing the rear of the housing. A secondary housing member mateable with the first housing member engages the conductors during mating to force the conductors into slots within the insulation displacement portion of the individual terminals. In this manner, substantially simultaneous connection can be made to both power and signal conductors. Each of the plug contact portions of the individual terminals is contained within a cylindrical projection or silo and is, therefore, substantially inaccessible to avoid inadvertent shorting. The cavity containing the plug contact portions is also configured to receive a mating plug housing when the plug and receptacle terminals are intermated. Rotatable covers in the form of doors are located at the plug receiving opening of the receptacle to environmentally isolate the receptacle contacts. When a plug is appropriately keyed to the receptacle cover and the cover doors and is inserted into the receptacle, the cover doors move back and the exterior surface of the covers provide a guide to align the plug with the mating receptacle contact configuration.

In the preferred embodiment of this invention, the mating edges of the doors are offset, thus requiring one door to close prior to the other. The contour of the exterior of the plug and the outer face of the doors serves to cause one door to begin closing prior to the other door, thus ensuring proper positioning of the doors in the closed configuration. BRIEF DESCRIPTION OF THE DRAWINGS FIG. 1 is the preferred method of installing the receptacle within the wall against a stud.

FIG. 3 is a cross-sectional view taken through lines 3—3 of FIG. 2.

DETAILED DESCRIPTION OF THE PREFERRED EMBODIMENT

Figure 1:
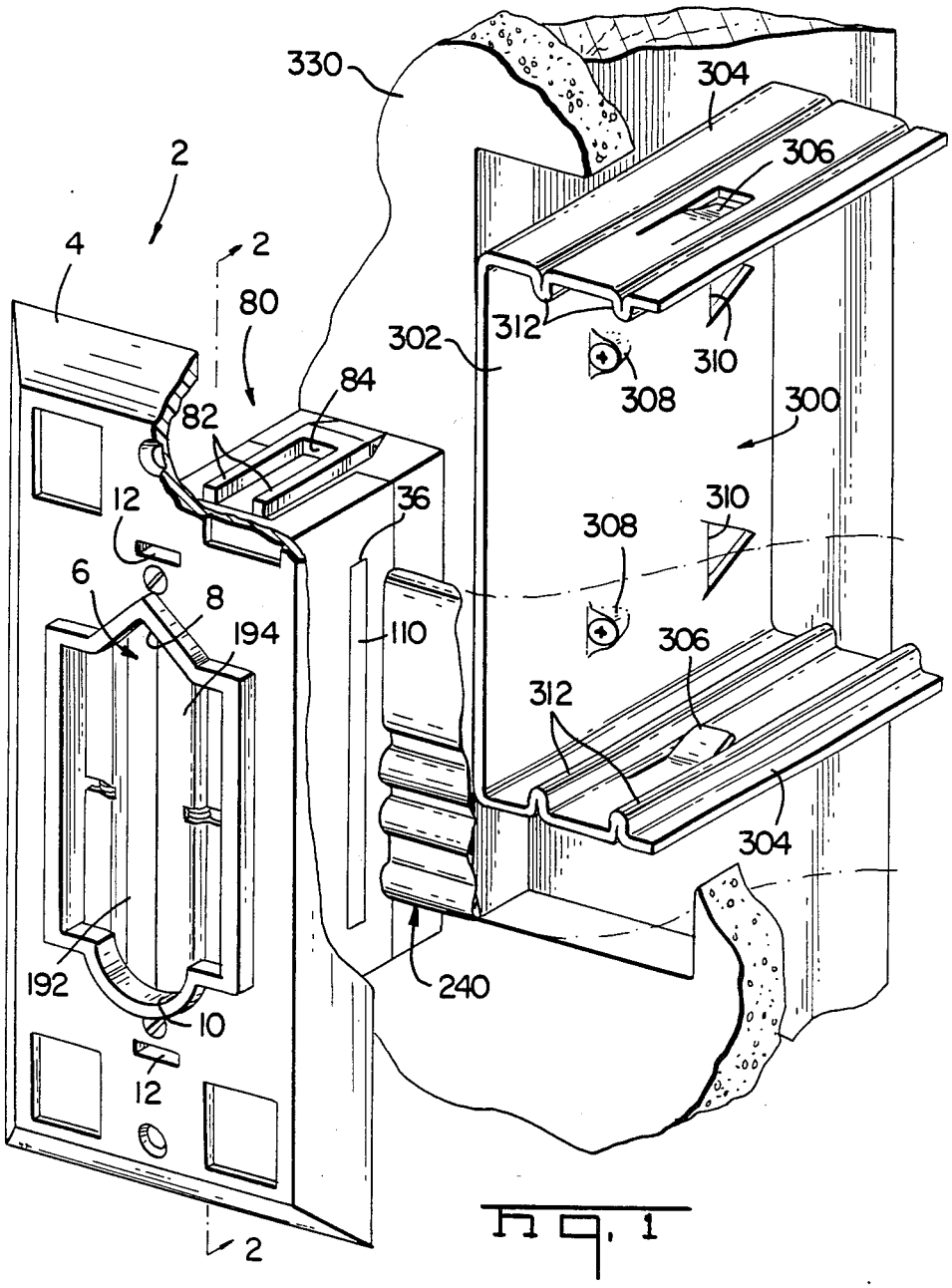
FIG. 1A is a method of mounting the receptacle within the wall intermediate two studs.

The instant invention relates to a receptacle for mass terminating a flat multi-conductor cable using insulation displacement techniques. The cable could comprise power, signal, control and communications wires integrally formed in a single cable. The power cable would include a hot wire, a neutral wire and a ground wire. The signal conductors could be used for telephone, high speed computer communications, audio systems, burglary alarm systems or intercom systems. The signals could be digital or analog. The individual signal wires could be shielded or unshielded.

The cable and receptacle comprise elements of an improved electrical distribution system which can be used for premise wiring. This system would be suitable for improved residential wiring. In the preferred embodiment the power contacts are capable of handling a UL approved current rating of 15 amps at either 120 VAC or 48 VDC. By using a heavier gage material for the contacts, the receptacle can accommodate a UL approved current of 20 amps which could be used in a kitchen or utility area as required by the UL code. A receptacle, according to the preferred embodiment of this invention, can terminate three 14 AWG solid copper wires while the heavy duty receptacle will terminate three 12 AWG solid copper wires. The signal side of the receptacle depicted herein includes ten female contacts designed to handle a UL approved current rating of 0.25 amps at 12 VDC and is capable of mass terminating ten 26 AWG solid copper wires utilizing the IDC techniques. The cable 240 is of the type suitable for incorporation of three 14 AWG solid copper conductors and a plurality of signal conductors, such as 26 AWG solid copper wires within a common insulation. The detailed description of the preferred embodiment will now be made with reference to the various figures.

Referring to FIG. 1, the subject receptacle, shown generally as 2, includes a face plate member 4 with a polarized plug opening 6. The plug opening 6 includes a triangular portion 8 at the top of the plug opening and a semi-circular portion 10 at the bottom of the polarized opening, although other polarization features could be employed.

Figure 2:
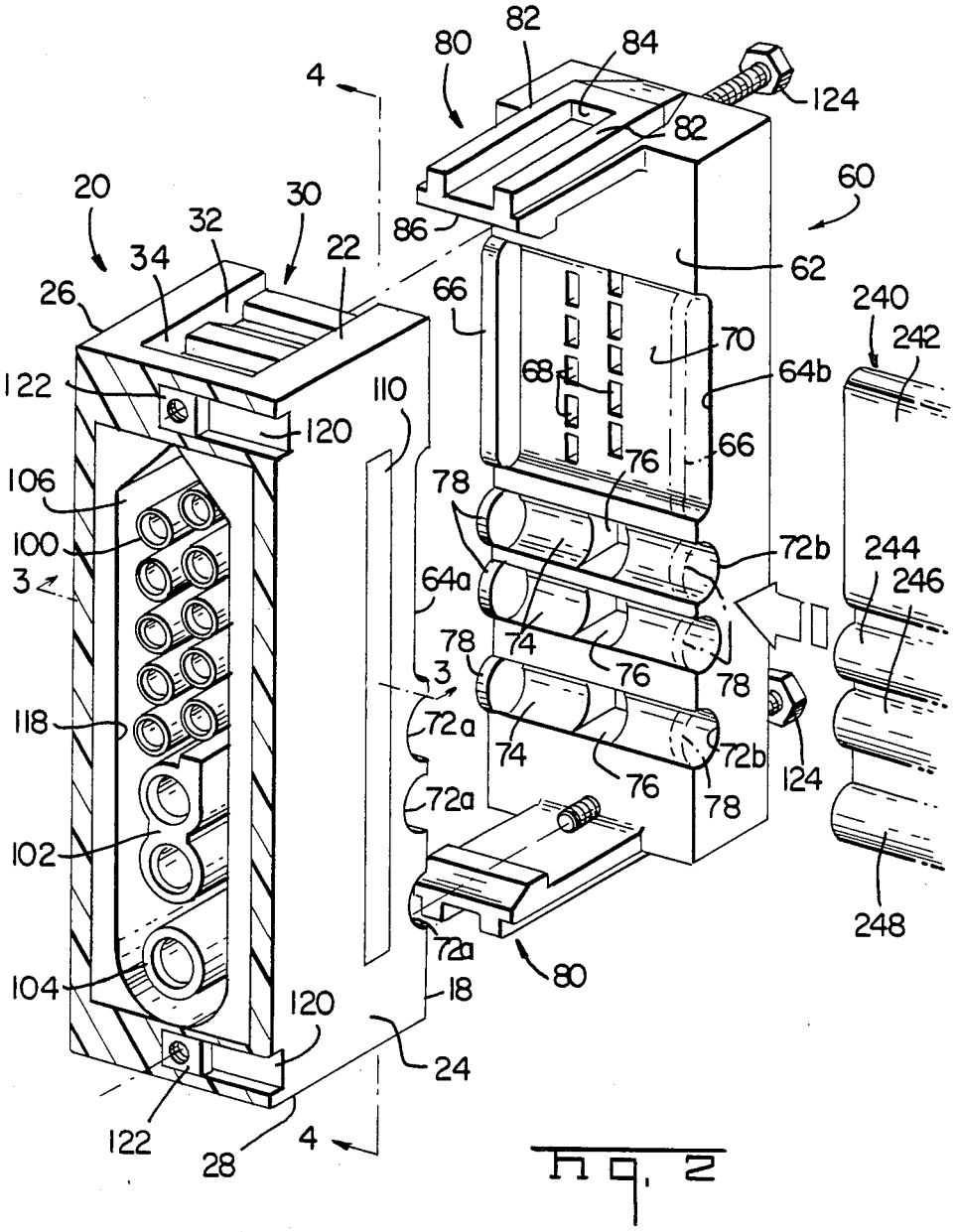
FIG. 2 is a perspective view of the preferred embodiment taken through lines 2—2 of FIG. 1.
Figure 4:
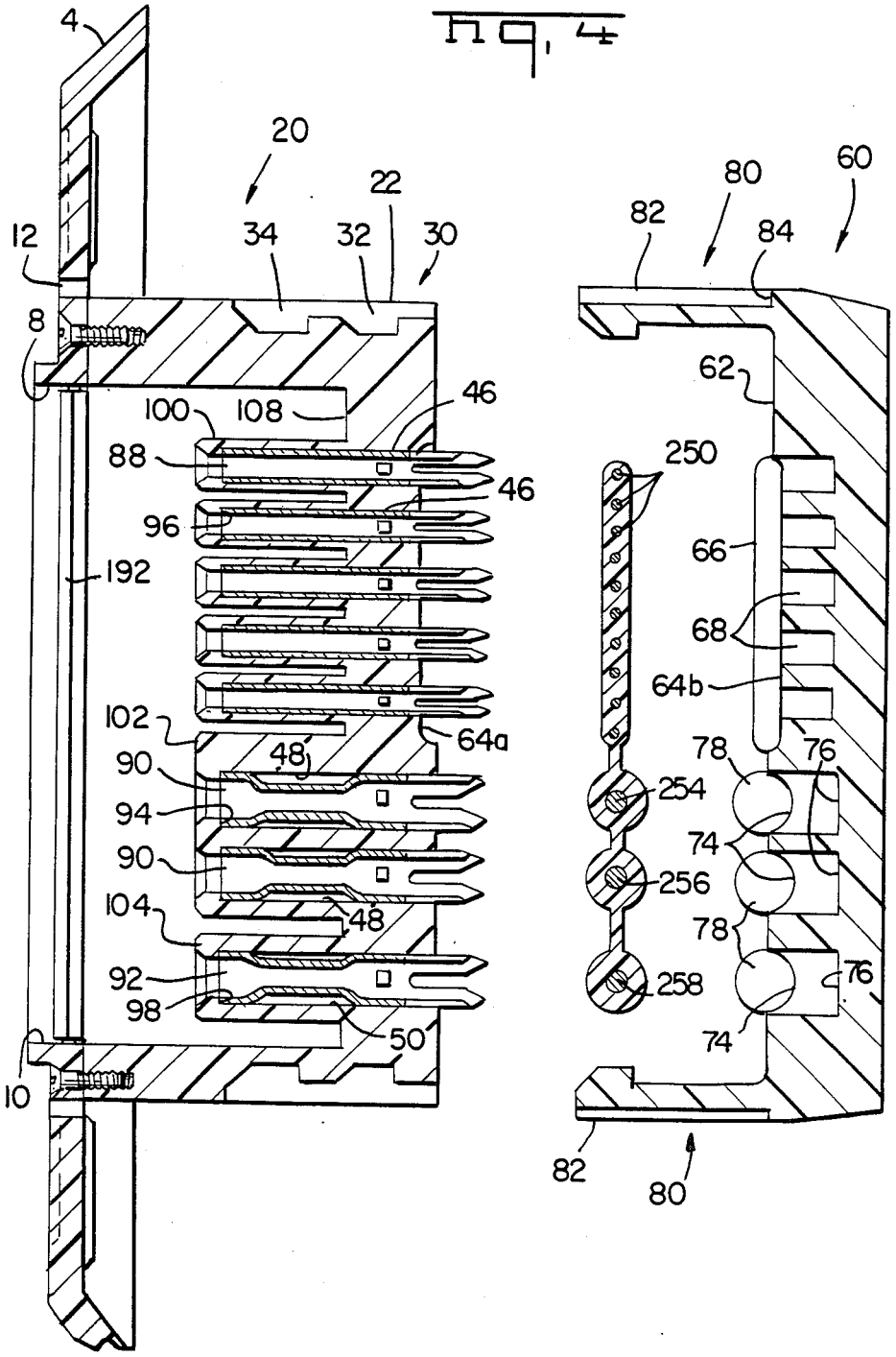
FIG. 4 is a cross-sectional view taken through lines 4—4 of FIG. 2.
Figure 5:
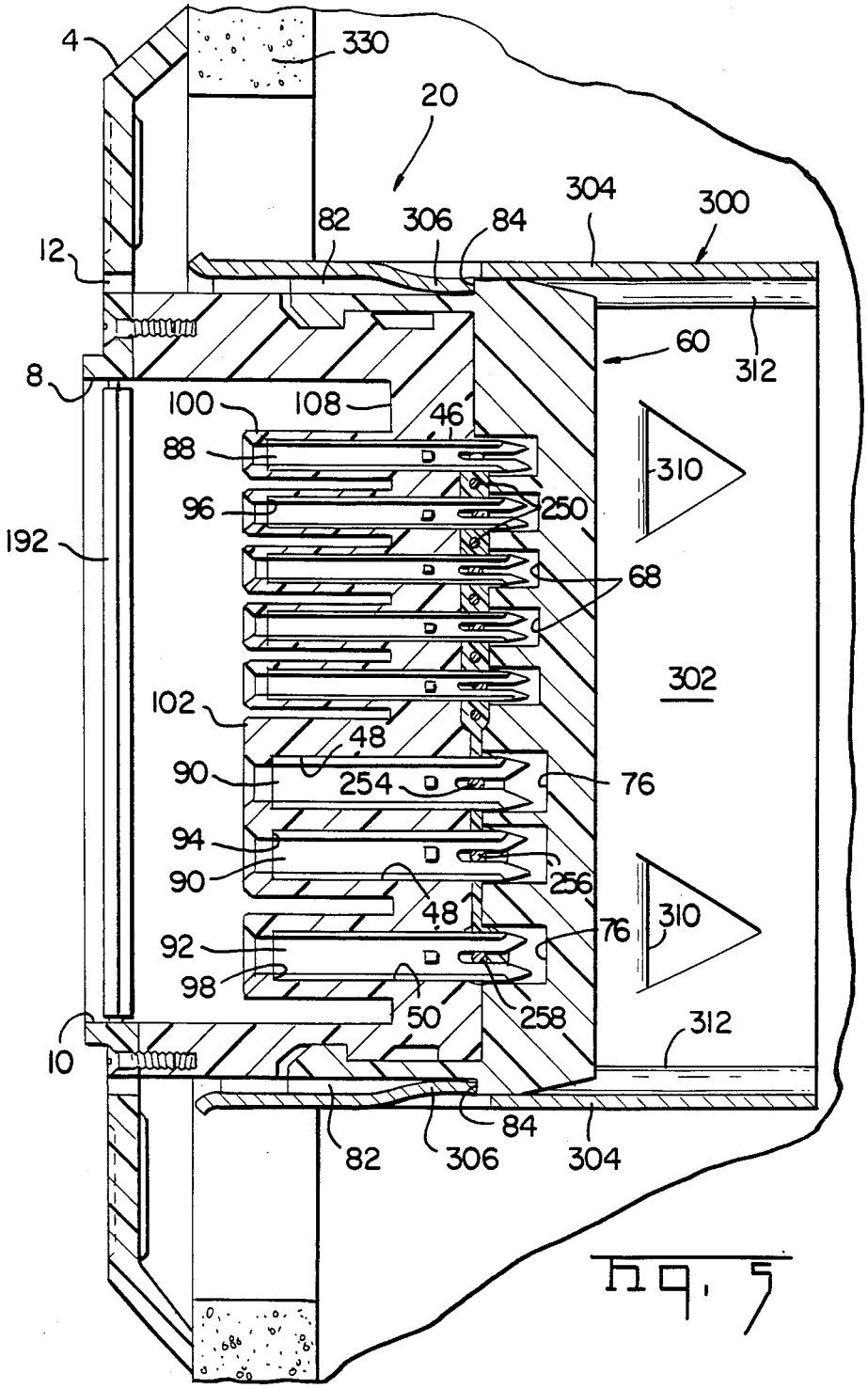
FIG. 5 is a view similar to FIG. 4 showing the cable completely terminated in the terminals.

Referring now to FIG. 2, the receptacle portion 20 is shown in greater detail. The receptacle portion 20 includes end walls 22 and 28, and sidewalls 24 and 26. The pin receiving area is defined by a plurality of silos, or cylindrical projections, 100 extending over the signal contacts, a double silo 102 extending over the power and neutral contact, and a silo 104 extending over the ground contact. A cavity 106 surrounds the various silos and is profiled as that of the plug receiving opening 6. The cavity 106 terminates at a back wall 108 as best shown in FIG. 4.

A wire receiving or terminating portion 60 located at the rear of the receptacle includes a front face 62 and two latch members 80 placed at the top and bottom of the wire receiving portion 60. The contact housing portion 20 and the wire receiving portion 60 are cooperatively profiled to interlock and define entries for cable 240. As best shown in FIG. 2, rear face 18 of contact housing portion 20 includes a recess **64*a* while a mirror image recess, shown as 64*b*, is included on the front face 62 of the wire receiving portion 60. Similarly, the rear face 18 of the contact housing portion 20 includes semicircular recesses 72*a* which, when mated with the semicircular recesses 72*b* in wire receiving portion 60, form circular entryways for the round power conductors 244, 246, 248. Two latch members 80 are disposed above and below the wire receiving recesses on the wire receiving portion 60 and are profiled to interconnect with two recesses 30 in end walls 22, 28** respectively of the contact housing portion.

The oblong recess 70 comprises oblong knockouts 66 disposed on both sides of the wire receiving portion 60 and the circular recesses 74 of the wire receiving portion 60 includes circular knockout members 78. Apertures 68 in the oblong wire receiving surface 70 and apertures 76 in the circular recessed portion 74 are profiled to receive the insulation displacement portions of terminals, which will be described hereinafter.

Figure 6:
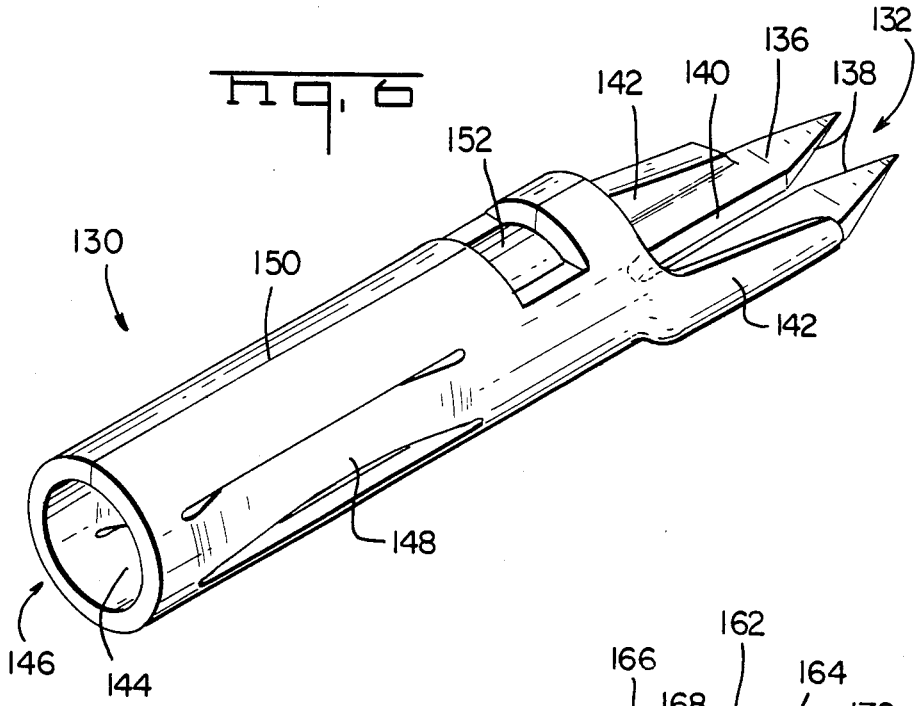
FIG. 6 is a perspective view of the power contact of the instant invention.
Figure 7:
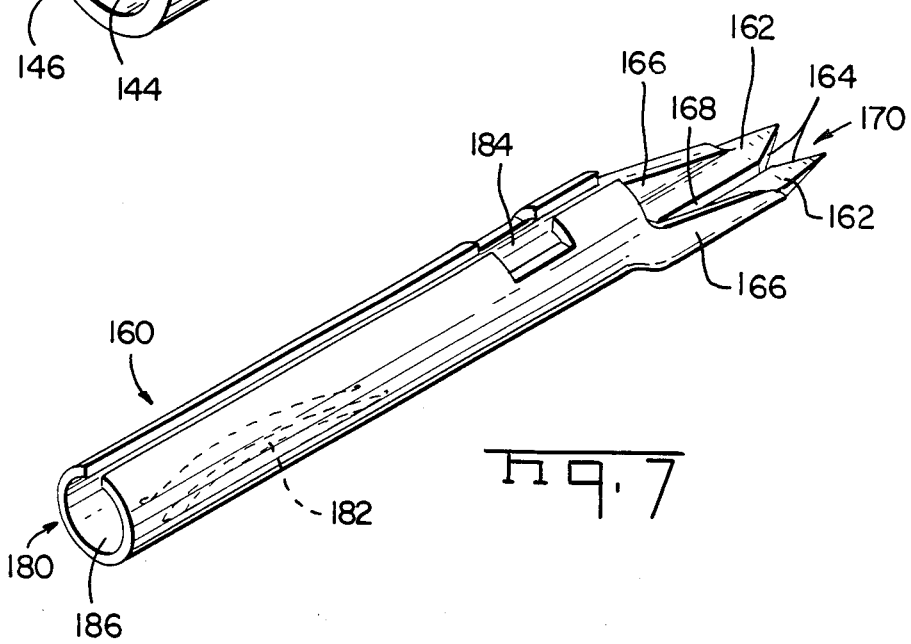

Referring now to FIG. 6, the power contact 130 is shown as having an insulation displacement portion 132 and a pin contact portion 146. The insulation displacement portion comprises two upstanding plate portions 136 defining two parallel and opposed sheared edges 140 for receiving a power conductor of one of the wires 244, 246, or 248. The upstanding plate portions 136 include insulation displacing portions 138. The terminal 130 further includes formed sidewalls 142 integral with the upstanding plate portions 136 which add to the rigidity of the insulation displacement slot portion 132. The remainder of the terminal 130 is rolled into a tubular configuration having a seam 150. The pin contact portion 146 is formed by the cylindrical portion and comprises a pin entry 144 and sheared strip portions 148 inwardly biased to provide a radial contact force on a pin inserted through the pin entry 144. The terminal 130 further comprises an alignment window 152 which will be described in greater detail subsequently.

Figure 7:
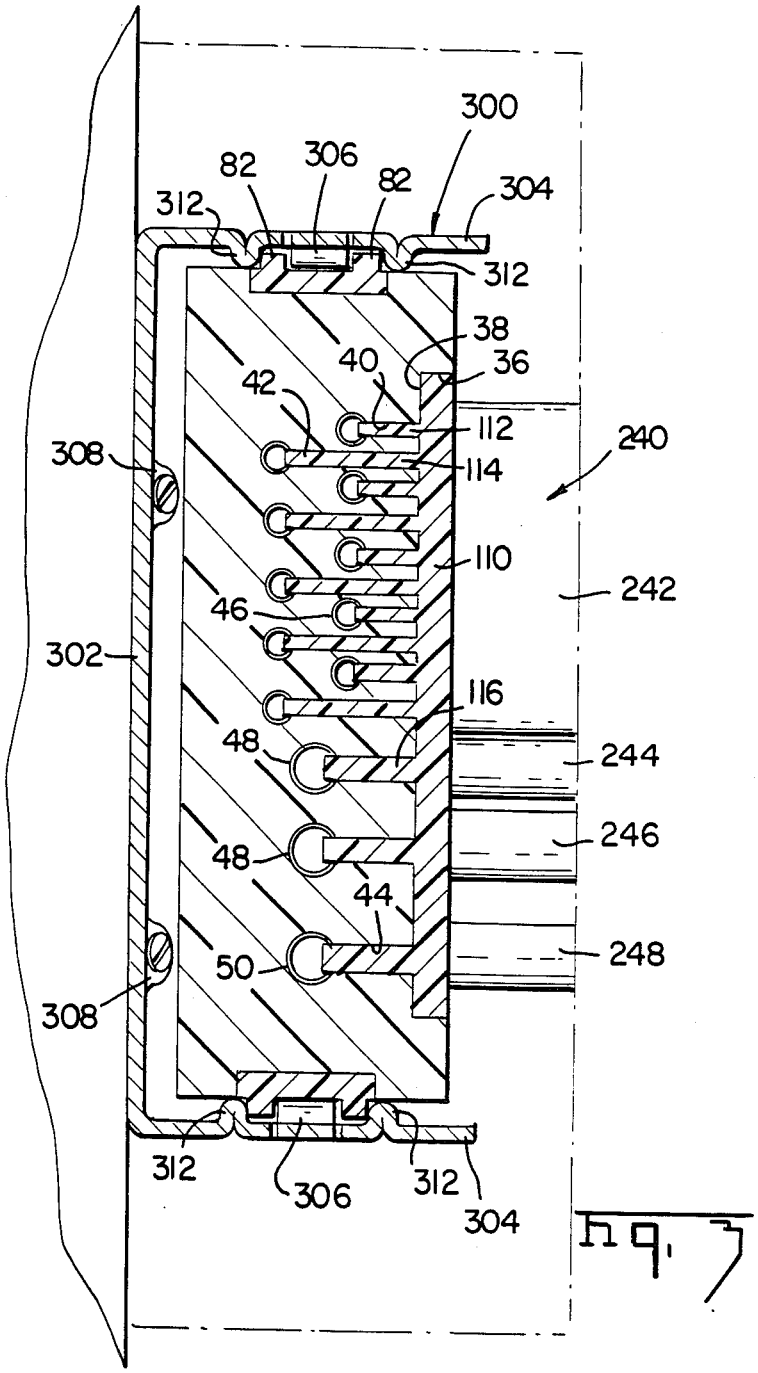
FIG. 7 is a perspective view of a signal contact of the preferred embodiment of the instant invention.

The signal contact 160 is shown in FIG. 7 and is similarly designed to the power terminal 130. The signal terminal includes an insulation displacement portion 170 and a resilient contact portion 180. The insulation displacement portion 170 comprises two plate portions 162 defining two sheared edges 168 for terminating a signal conductor. Integral with the upstanding plate portions 162 are sidewall portions 166 which again add to the rigidity of the insulation displacement portion 170. On the upper portion of the upstanding plate portions 162 are included insulation piercing portions 164. The resilient contact portion 180 includes a sheared strip 182 inwardly biased to provide the radial force on the signal contact. The terminal further comprises an alignment window 184 which will be described in further detail subsequently.

Figure 8:
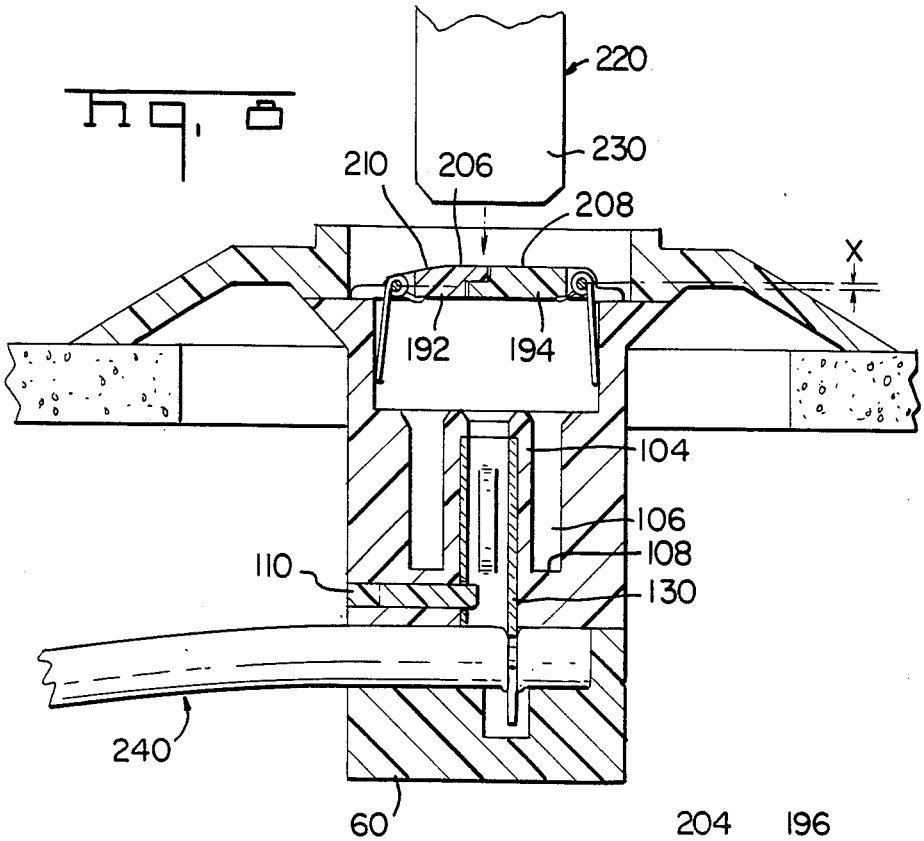
FIG. 8 is a cross-sectional view taken through the center of the receptacle showing a door assembly prior to the plug insertion.
Figure 9:
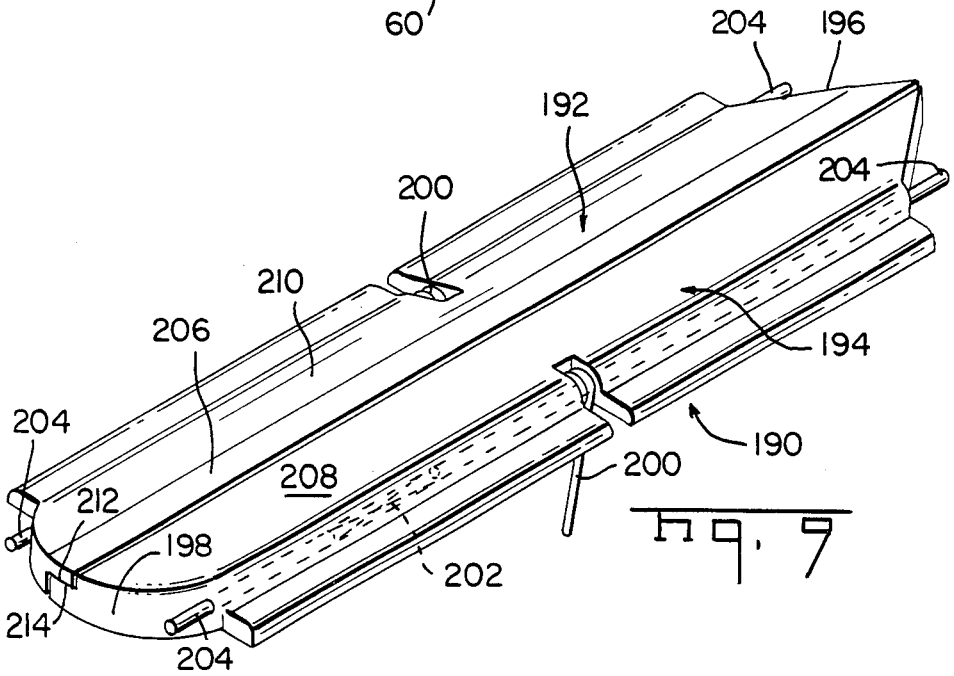
FIG. 9 is a perspective view of the door assembly of the instant invention.

As shown in FIG. 1, the plug receiving opening 6 comprises two door members 192 and 194 which swing open upon receipt of a mating plug member in the opening 6. The doors 192 and 194 are shown in FIG. 9 for illustrative purposes and include mounting pin members 204, each having a compression spring 202 therein, the pin members 204 being compressably retractable into its aperture in order to originally install the doors in an aperture in the housing member 20. The doors further comprise torsion spring members 200 to retain the doors in the closed position when the plug member is not in place. The door members 192, 194 are profiled with complementary overlapping notch members 212, 214 to deter environmental contaminants from entering the contact area. The door member 194 is profiled with a substantially planar surface 208 while the door member 192 is profiled with a flat section 206 and a reclining surface 210 as best shown in FIG. 8. The exact functioning of the doors will be described in greater detail later.

The instant invention can be used to terminate a plurality of signal conductors and power conductors, the signal and power conductors being encapsulated into one multi-conductor cable. Mass termination of the plurality of conductors requires that the plate portions 136 of the power terminals 130 and the plate portions 162 of the signal terminals 160 all lie in parallel planes. As best shown in FIG. 4, all power terminals are inserted into their respective silos until the ends of the normal face contact portions abut respective shoulders 94, 98 within the silos, the shoulders 94, 98 facing towards the insulation displation portion. Similarly, the signal contacts 160 are installed within the silos 100 until the ends of the normal force contact portion abut shoulders 96. When the terminals 130 and 160 are so installed in the silos, the respective alignment apertures 152 (FIG. 6) and 184 (FIG. 7) are axially aligned within the silo with a window portion 36 (FIG. 1). As shown in FIG. 3, the window 36 is in transition with a plurality of apertures 40 and 42 which extend from a back wall 38 of the window 36 and into the interior portions of the silos 100, aligning themselves with the portions 184 of the signal terminals 160. Similarly, respecting the power terminals, the window 36 is in alignment with a plurality of apertures 44 extending from the window to each of the silos 102, 104 and extends into the silo and is aligned with the aligning apertures 152 when the power terminal 130 is inserted within the silo. With each of the aligning apertures of the signal and power terminals axially and rotatably aligned with each of the apertures extending from the window, a comb member 110 is insertable into the window and has teeth members 112 insertable into aperture 40, teeth members 114 insertable into aperture 42 and teeth members 116 insertable into aperture 44. As shown in FIG. 3, the teeth members are in varying lengths to extend themselves into the silo and through the alignment portion of the terminal preventing rotation of the terminals within the silos which retains the insulation displacement portions of all terminals in a common plane for termination of the conductors. The teeth members also retain the terminals in an axially fixed manner with respect to each of the silos.

As best shown in FIG. 2, the housing portion 20 includes an intermediate latch position 32 and a closed latch position 34, while the wire receiving portion 60 has latch members 80 having a latching finger 86. With the housing members 20 and 60 partially mated, the latch member 86 located within the intermediate latch position 32, the multi-conductor flat cable 240 may be easily inserted between the housing members 20 and 60 for termination. Also, as shown in FIG. 2, the housing member 20 has a semi-oblong recess **64*a* and a semi-circular recess 72*a* which are aligned with semi-oblong recess 64*b* and the semi-circular recesses 72*a* aligned with semi-circular recesses 72*b* in housing member 60. The housing member 60 also includes knockout portions 66 on both sides of the housing member in each of the semi-oblong recesses 64*b* and the housing member 60 further includes knockout portions 78 on either side of the housing member in each of the semi-circular recesses 72*b*. Thus, the multi-conductor cable 240 is insertable from either the right side or from the left side, as shown in FIG. 2, by simply removing respective knockout portions and placing the wire within the housing member 60 with the flat conductor section 242 abutting the flat conductor receiving section 70 and each of the power conductors 244, 246, 248 abutting the semi-circular surfaces 74. The knockouts 66, 78 are only removed from the side from which the multi-conductor flat cable is to be installed thereby providing a means to detect when the cable is fully installed and a means to seal the connector housing from the opposite side. The two housing members 20 and 60 may now be forceably connected by means of jack screws 124 (FIG. 2**) bringing the two housing members together, terminating each respective terminal with a conductor of the flat multi-conductor cable.

As shown in FIG. 4, each of the terminals are aligned with a conductor of the flat multi-conductor cable. When the two housing members 20 and 60 are fully mated, each of the terminals terminate a respective conductor and each terminal extends into the housing portion 60, the power terminals 130 extending into apertures 76 and each of the signal contacts 160 extending into apertures 68 (FIG. 2).

The preferred method of terminating the signal conductors and the power conductors by bringing the two housing members 60 and 20 together is shown in FIG. 2. Jack bolts 124 extending through holes in housing 60 are aligned with square head nuts 122 and installed in apertures 120 in the housing member 20.

With the multi-conductor flat cable 240 fully installed within the housing members 20 and 60, the receptacle portion 2 can then be installed within a wall such as a building, for later interconnection thereto. As shown in FIG. 1, the preferred method of installing the receptacle portion 2 to a stud within a wall requires a mounting bracket 300 having angular bosses 308 and lances 310 struck from a sidewall 302 of the mounting bracket 300. The mounting bracket 300 further comprises ribbed portions 312 on each of the end walls 304 and latch members 306 struck from the end walls extending towards the center of the bracket. A hole through the dry wall is then routered such that one of the edges of the routered hole is aligned with a stud within a wall and the mounting bracket 300 is insertable into and through the hole and may be fastened to the stud via screws through the angled bosses 308. The lances 310 are also driven into the stud securely fastening the bracket member 300 to the stud. It should be noticed that the design of the bracket 300 and the receptacle 2 are such that the routered hole through the dry wall may be placed such that the left edge or the right edge of the routered hole abuts the plane of the stud, the mounting bracket can simply be rotated such that the plate portion 302 of the bracket is against either side of the stud. The receptacle portion 2 is then insertable into the mounting bracket 300 with the ribbed portions 82 of the housing member 20 aligned inside of the channel defined by the guide ribs 312 of the mounting bracket 300. The receptacle 2 is insertable into the mounting bracket 300 until the latch members 306 lock themselves behind latch surface 84 locking the receptacle within the wall. Apertures 12 are located on the front of the face plate 4. In the event the receptacle portion needs to be removed, a thin screw driver or similar blade member may be insertable through the aperture 12 releasing latches 306 from surfaces 84.

Figure 1A:
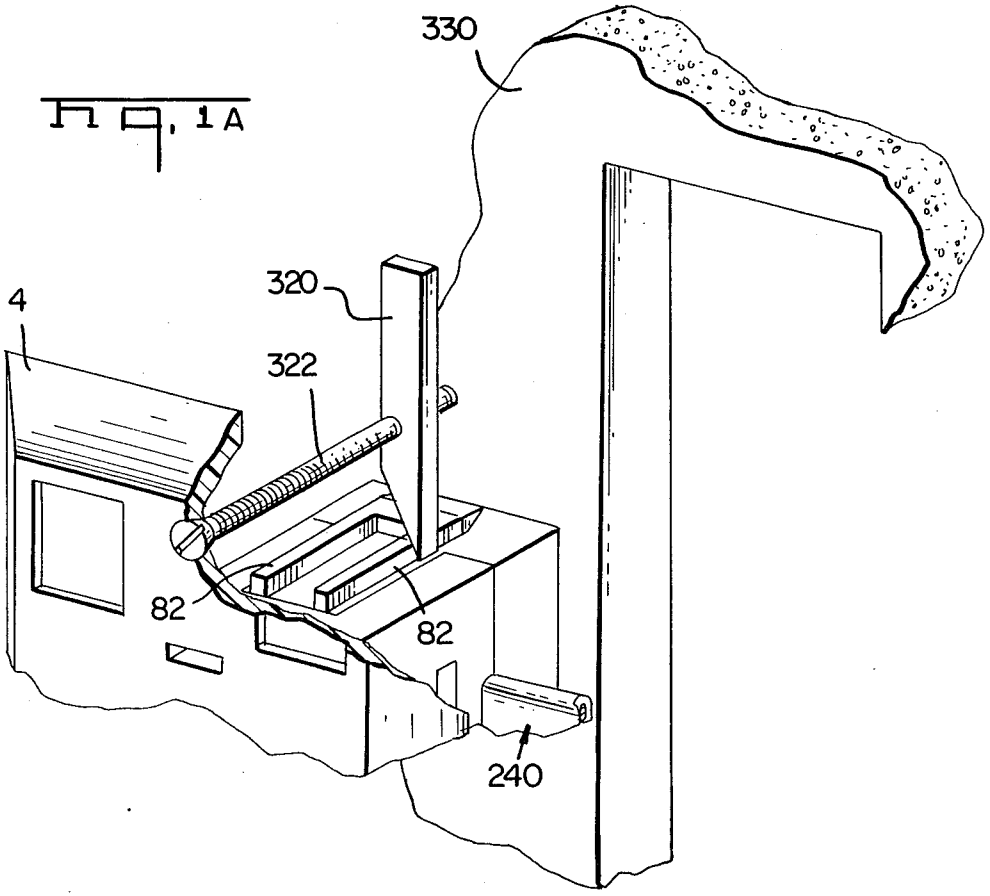
Figure 10:
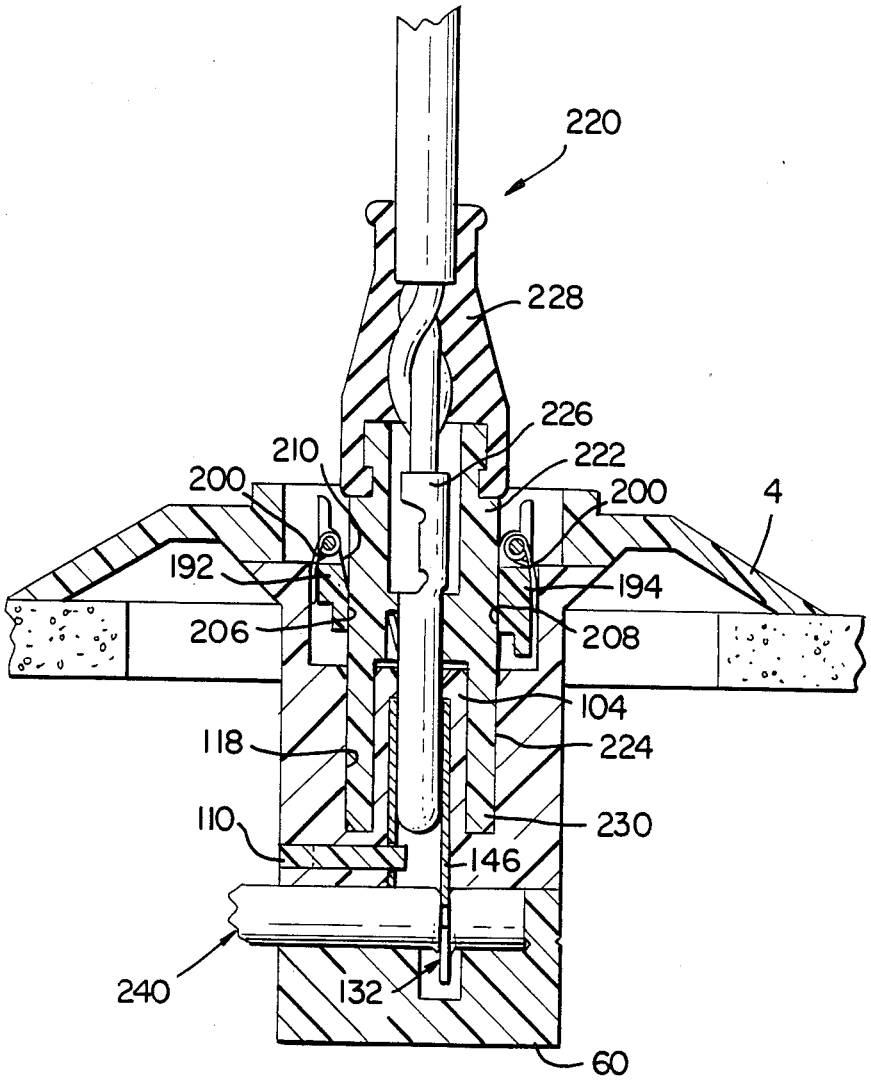
FIG. 10 is a view similar to that of FIG. 8 showing the plug fully inserted.
Figure 11:
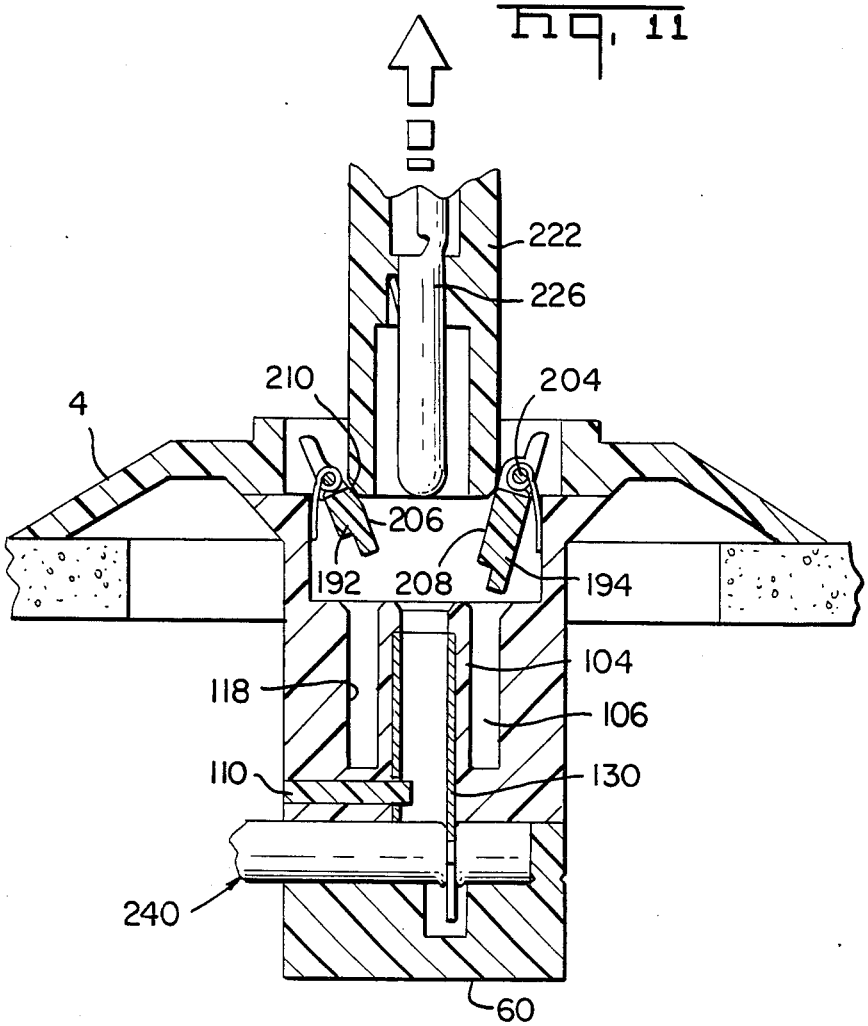
FIG. 11 is a view demonstrating the sequential closing of the door assembly.

If the receptacle needs to be installed intermediate two studs, a rectangular hole may routered through the drywall 330, as shown in FIG. 1A, and screws 322 and swing nuts 320 may be employed. The screws are inserted through respective holes in the face plate 4 and swing nuts partially threaded upon screws 322, the swing nuts 320 are then turned to horizontal position in order that the receptacle may clear the hole in drywall 330. When the screws are then tightened down, the swing nuts will turn with the screws 322 until the swing nuts 320 abut ribbed members 82. Continued turning of the screws will draw the receptacle face plate 4 up to the drywall to a flush position. With the receptacle portion 2 fully installed, a plug member 220 would then be insertable through the opening 6 for interconnection to respective pin contact portions of the signal and power terminals. As shown in FIG. 10, the plug portion would contain a housing member 222 with pin contacts 226 installed therein and an overmolded grommet portion 228 which protects and seals the pin contacts 226 and further adds as a strain relief device for the plurality of conductors.

As shown in FIG. 1, two door members 192, 194 are provided which add a deterent effect for contaminants entering into the contact cavity. As shown in FIG. 9, the doors overlap one another with surfaces 212 and 214 in a contacting relationship. As shown in FIG. 8, the front portion of the plug member 220 will enter the receptacle member 2 and open the doors, allowing access to the respective contact members.

As shown in FIG. 10, the plug member 220 is fully inserted within the receptacle portion with the door members 192, 194 fully opened. The profile of the surfaces 206, 208 of the door members 192, 194 respectively provide an aligning feature of the plug member with respect to the contact terminals. Upon removal of the plug member 220, the doors include a torsion spring 200 and are spring loaded when opened, thus removal of the plug member closes the door members. To ensure that the door members close in the proper sequence, that is that door member 192 closes prior to door member 194, the rotation axis about which each of the doors closes is slightly offset by a distance X, as shown in FIG. 8. Door member 192 also includes a sloping surface 210. The combination of the sloping surface 210 and the offset X of the door members 192, 194, assures that door member 192 closes prior to the closing of door member 194.

Figure 12:
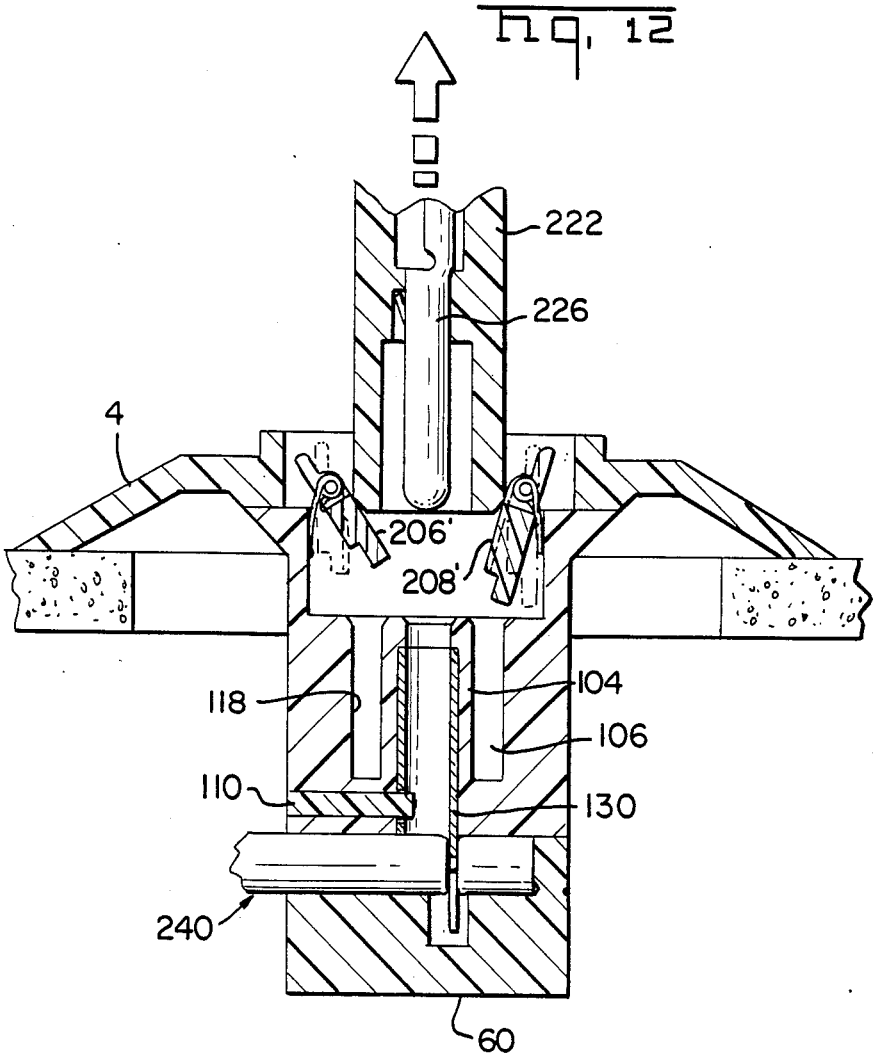
FIG. 12 is a view of an alternate embodiment also showing the sequential closing of the door assembly.

Alternatively, the doors could be profiled to include a raised pattern, such as shown in FIG. 12 on the surface of the door to close last, that is surface 208', a raised section such as lettering, a horizontal rib or just a thicker door. Raising the contacting surface between the plug and receptacle on the door to close last, also opens that door first and maintains that door open while the other door closes upon retraction of the plug.

The plug member 220 and the receptacle portion 2 are each profiled to prevent accidental damage to the respective pins 226 and contacts 130, 160 when in the unmated position and cooperatively profiled to prevent damage to the combination of pins and contacts upon insertion of the plug into the receptacle. It should be understood that this plug portion 220 would be used instead of the present plug which is used on all electrical appliances which has a body portion and two power prongs and one ground prong extending therefrom. The prongs of the present plug are susceptible to bending while installed in the present receptacles due to the electrical cord being pulled, while the plug housing and or prongs are susceptible to damage when not installed due to being stepped on, or the like.

As best shown in FIG. 2, the receptacle portion 20 includes a cavity portion surrounding each of the contact portions. The hot and neutral power contacts 130 include a silo 102 in surrounding relationship thereto, while the ground contact 130 includes a silo 104 therearound. Each of the signal contacts 160 also include a silo 100 therearound. Thus, each of the power and signal contacts are separately protected from damage, yet provide a cavity portion 106 for receiving a plug member 220, which too, is completely protected from damage.

As best shown in FIG. 10, the plug portion 220 includes a housing member 222 having a shroud member completely surrounding the pin portions 226 which are slightly recessed from the end of the shroud. This protects the pins when inserted and when not inserted as the pins cannot be stepped on.

The plug and receptacle are each cooperatively profiled to protect the pins and contacts when in the mated position. The plug member 220 is similarly profiled as the interior cavity 106 of the housing portion 20 for a closely toleranced fit. As best shown in FIG. 10, the housing portion 222 includes an outer surface 224 surrounding the plug shroud 230 which fits substantially flushly against the interior surface 118 of the cavity 106. The pins cannot be damaged upon insertion of the plug 220 into the cavity 106, as the shroud 230 extends beyond the pins 226, and as the respective silos extend beyond their contacts, the plug shroud 230 must always be over the silos prior to the pins and contacts mating. This aligns the respective pins and contacts preventing the pins from being bent during insertion. To further prevent damaging the pins and contacts, the shroud 230 is profiled to carry the load against the back wall 108 (FIG. 4), rather than letting the pins bottom out within the contacts.

Although the plug and receptacle depicted herein each contain a full compliment of contacts, it should be understood that there may be some applications which do not require all of the terminals. The receptacle and plug depicted herein are each suited for the removal of terminals which may not be needed in a particular application. The side by side alignment of the contacts also would be suited for use with a plug which does not extend along the entire length of the plug receiving opening. In this latter instance, the door assembly could be divided into a plurality of individual sections, each independently shiftable. Since the doors rotate inwardly, access would be possible to only that portion of the receptacle which would mate with the plug.

The preferred embodiment of the invention is shown herein as a receptacle portion having contact portions aligned longitudinally with respect to each other defining a rectangular receptacle. The signal contacts are shown as being aligned in two parallel offset rows for contacting closely spaced conductors in flat cable. It should be understood that one skilled in the art could rearrange the contacts to redefine the configuration without varying from the scope and intent of the following claims.

What is claimed:

1. An electrical receptacle matably connectable to an electric plug, the receptacle comprising:

a housing portion having a plurality of contacts therein accessible through an opening in a mating face, the opening further comprising a door assembly including first and second individual doors which, when contacted by the mateable plug open to expose the contacts, the first and second doors each having a mating overlapping edge profiled to preclude a gap between the doors into the terminal cavity, said doors being profiled such that said second door substantially always closes prior to the first said door when said plug is removed, thereby realigning the overlapping profile of the first and second doors.

2. The receptacle of claim 1 wherein the doors rotate about an axis remote from the overlapping edges.

3. The receptacle of claim 2 wherein the distance between the overlapping edge and the rotation axis of the first said door is shorter than the distance between the overlapping edge and the rotation axis of the second said door.

4. The receptacle of claim 1 wherein the axes of rotation of the first and second doors are axially offset from one another.

5. The receptacle of claim 1 wherein the doors have biasing means to normally bias the doors to the closed position.

6. The receptacle of claim 1 wherein the doors, when in the fully open position, are profiled to align the mateable plug with the receptacle terminals.

7. The receptacle of claim 1 wherein the first said door includes a surface for the plug to contact which is raised from that of the second said door which opens the first said door upon insertion of said plug and closes the first said doors last upon retraction of the plug.

8. An electrical receptacle for interconnecting to a cable comprising signal and power conductors and for mating with a plug having a plurality of contacts therein and a shroud member as part of a plug housing extending therearound beyond the length of the pins, the receptacle comprising:

a plurality of contact members, each contact member having a first contact portion and an insulation displacement portion for terminating respective power and signal conductors of the cable;

a first housing member having a plug receiving face and a rear face, the plug receiving face having a plug receiving opening extending therein defined by an inner surface of the first housing member and a back wall, the first housing member further comprising a plurality of silo members extending from the back wall towards the plug receiving face, the silo members having contact receiving openings extending from ends of the silo members through the first housing member to the rear face, at least some of the silo members having a contact member installed therein with the first contact portion towards the end of the silo proximate the plug receiving face and the insulation displacement portion extending beyond the rear face;

a second housing member comprising a front face profiled to fit substantially flushly with the rear face of the first housing member, the second housing member comprising apertures aligned as said contacts in said first housing member for receiving the insulation displacement portions therein, when the rear face of the first housing member and the front face of the second housing member are contacting; and opening means for receiving the cable and accessing the insulation displacement portions of the contacts for termination thereto.

9. The receptacle of claim 8 wherein the opening means comprises a first profiled recess in the rear face of the first housing member and a second profiled recess in the front face of the second housing member, the first and second recesses cooperatively profiled to accept the cable, when the first and second housing portions are mated.

10. The receptacle of claim 9 wherein the recesses are profiled to receive flat multiconductor cable comprising round power conductors and an oblong section of signal conductors.

11. The receptacle of claim 8 wherein the plug receiving opening is profiled as said plug such that an outer surface of the plug shroud fits substantially flushly with the inner surface of the plug receiving opening.

12. The receptacle of claim 11 wherein the plug receiving opening is profiled such that the end of the plug shroud abuts said back wall in said plug receiving opening when said plug and receptacle are mated.

13. An electrical connector, for terminating therein a plurality of densely arranged conductors of a multiconductor cable, comprises a plurality of contacts including an insulation displacement portion comprising a plate section having parallel and opposed sheared edges defining a slot for receiving a conductor therein in a direction transverse to that of the plate, each contact further comprising an alignment opening in a portion of the contact; the connector further comprising a housing member having a plurality of openings for receiving the contacts therein, the contacts being arranged in two staggered rows, the housing member further comprising a plurality of apertures extending through the housing in a direction transverse to that of the contact openings, a first set of said apertures being alignable with the alignment openings in said first row of contacts, and a second set of said apertures extending intermediate the contacts of the first row, extending to the second row of contacts; and a comb means comprising a plurality of teeth profiled to be received in said apertures and through said alignment openings in said contacts thereby preventing axial and rotational movement of the contacts within said contact openings.

14. The connector of claim 13 wherein a portion of the contacts are profiled for receiving power conductors and the remainder of the contacts are profiled for receiving signal conductors.

15. The connector of claim 14 wherein the signal contacts are profiled to receive 26 AWG conductors.

16. The connector of claim 14 wherein the power contacts are profiled to terminate at least 14 AWG conductors.

17. The connector of claim 14 wherein the signal contacts are aligned in first and second parallel and opposed rows, the contacts in the first and second rows being laterally offset from each other, and the power contacts being aligned in a third row which is laterally remote from the first and second rows.

18. The connector of claim 17 wherein the alignment openings in the contacts each face in the same direction towards an outside surface of said housing, said outside surface including a recess for receiving said comb, said comb when inserted, aligning the plate portions and the conductor receiving slots of the contacts in three parallel planes for mass insertion of the multiconductor cable within respective power and signal contacts.

* * * * *